US007066848B2

(12) United States Patent
Unger

(10) Patent No.: US 7,066,848 B2
(45) Date of Patent: Jun. 27, 2006

(54) GOALTENDER TRAINING APPLIANCE

(76) Inventor: Robert N. Unger, 7 Swansea Cove, Winnipeg (CA) R3R 3J1

( * ) Notice: Subject to any disclaimer, the term of this patent is extended or adjusted under 35 U.S.C. 154(b) by 57 days.

(21) Appl. No.: 10/839,250

(22) Filed: May 6, 2004

(65) Prior Publication Data

US 2004/0266564 A1 Dec. 30, 2004

Related U.S. Application Data

(60) Provisional application No. 60/468,524, filed on May 7, 2003.

(51) Int. Cl.
*A63B 69/00* (2006.01)

(52) U.S. Cl. ..... 473/446

(58) Field of Classification Search ..... 473/446, 473/478, 447, 448, 422, 426, 434, 435, 449
See application file for complete search history.

(56) References Cited

U.S. PATENT DOCUMENTS 3,342,486 A * 9/1967 Farley ..... 473/448
3,856,298 A * 12/1974 Frantti ..... 473/446
4,921,257 A * 5/1990 Heller ..... 473/446
4,932,657 A * 6/1990 Hailer et al. ..... 473/446
5,688,197 A 11/1997 Peeters et al.
5,800,312 A 9/1998 Ormondroyd
6,402,641 B1 * 6/2002 Lee ..... 473/446
6,692,384 B1 * 2/2004 Bains ..... 473/446
6,913,551 B1 * 7/2005 Foley ..... 473/448

FOREIGN PATENT DOCUMENTS

CA 2373866 A1 8/2003
DE 34 03 897 A1 8/1985

* cited by examiner

*Primary Examiner*—Eugene Kim
*Assistant Examiner*—M. Chambers
(74) *Attorney, Agent, or Firm*—Ryan W. Dupuis; Michael R. Williams; Adrian D. Battison

(57) ABSTRACT

A training appliance for a goaltender is used in training goaltenders in a sport of the type having a goal including two, spaced apart upright posts and a crossbar joining the posts to define a goal mouth, foe example ice hockey. The appliance includes a band of stiff material and a mounting arrangement for mounting the band on the goal at a position spaced to a front side of the goal mouth and extending transversely across the goal mouth to be engaged by the goaltender to prevent backing into the goal in the face of oncoming play.

12 Claims, 3 Drawing Sheets

GOALTENDER TRAINING APPLIANCE

This application claims benefit of U.S. Provisional Application No. 60/468,524, filed May 7, 2003.

FIELD OF THE INVENTION

The present invention relates to the training of goaltenders for those sports which use a goal including two spaced uprights and a crossbar to define a goal mouth. Examples of such sports include hockey (field and ice) and box lacrosse.

BACKGROUND

In the training of goaltenders, particularly younger players, one of the difficult tasks is to train the new goaltender not to back up into the goal mouth. Various devices have been proposed in the past for teaching goaltenders to move away from the goal mouth to minimize the area of the goal mouth available to a direct shot. These do not, however, inhibit the natural tendency to back up too far towards the goal mouth as play approaches.

The present invention is concerned with an appliance that will provide tactile feedback to a goaltender during practice to warn the player when too close to the goal mouth.

SUMMARY

According to one aspect of the present invention, there is provided a training appliance for a goaltender in a sport of the type having a goal including two, spaced apart upright posts and a crossbar joining the posts to define a goal mouth, the appliance comprising a band of stiff material; and band mounting means for mounting the band on the goal at a position spaced to a front side of the goal mouth and extending transversely thereacross.

This provides a tactile warning to the training goaltender when too close to the goal mouth. It prevents retreat into the goal mouth and provides a reminder of position relative to the goal mouth.

The mounting means are preferably adjustable along the posts for adjusting the height of the band to accommodate goaltenders of differing stature, which is particularly beneficial when training younger players.

The band may be an elongate, resilient member, for example a strip of resilient plastic material, bowed outwardly across the goal mouth. The currently preferred mounting means are clamps for mounting opposite ends of the band on respective ones of the posts, although other embodiments may be as simple as elastic cords, e.g. "bungee" cords.

According to another aspect of the present invention there is provided a training goal comprising:

two, spaced apart upright posts;

a crossbar joining the posts to define a goal mouth;

a band of stiff material mounted on the goal at a position spaced to a front side of the goal mouth and extending transversely thereacross. In this case, the training appliance is part of the goal, even though it may be removable for regular play.

According to a further aspect of the invention there is provided a method of training a goaltender for a sport of the type having a goal including two, spaced apart upright posts and a crossbar joining the posts to define a goal mouth, the method comprising:

providing a band of stiff material;

mounting the band on the goal at a position spaced to a front side of the goal mouth and extending transversely thereacross; and practicing the sport.

BRIEF DESCRIPTION OF THE DRAWINGS

In the accompanying drawings, which illustrate an exemplary embodiment of the present invention.

DETAILED DESCRIPTION

Figure 1:
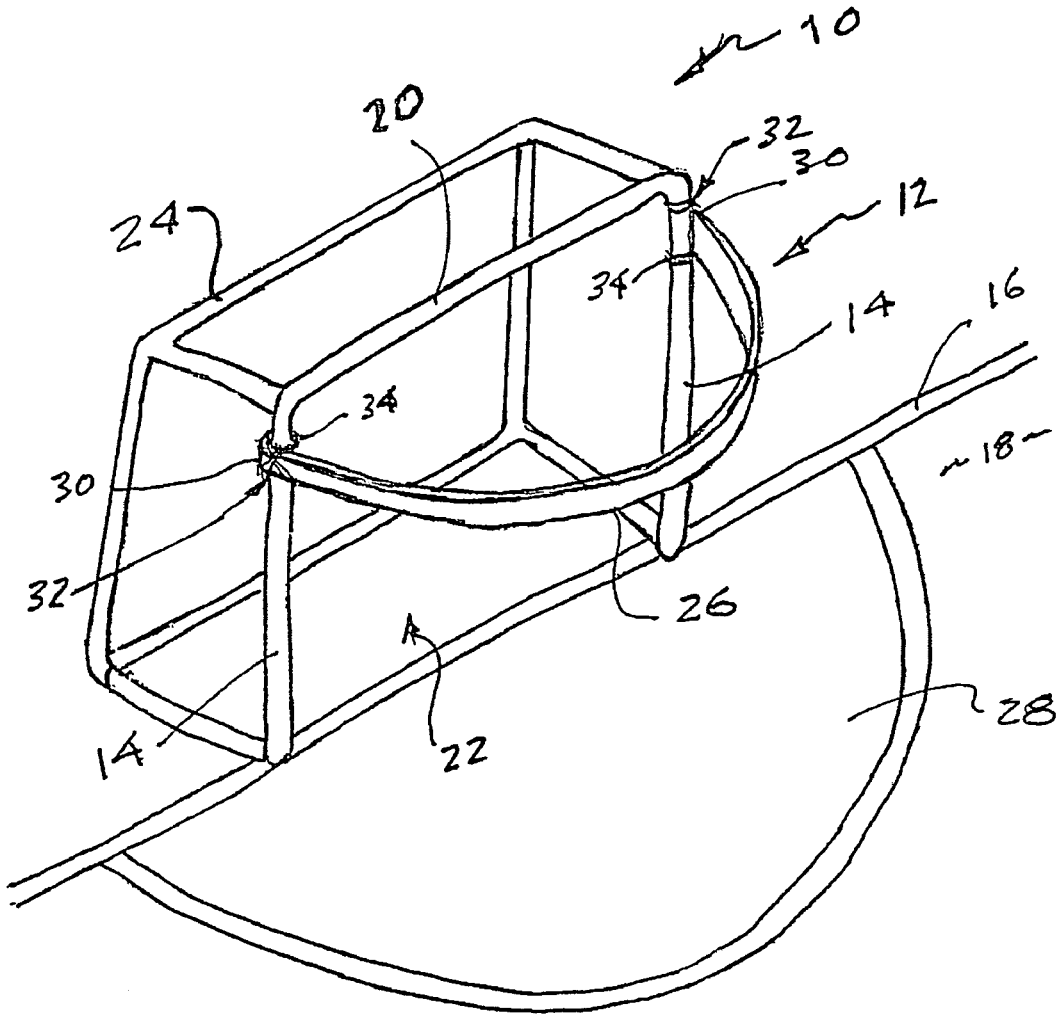
FIG. 1 is an isometric view of an ice hockey goal equipped with a training appliance according to the present invention.
Figure 2:
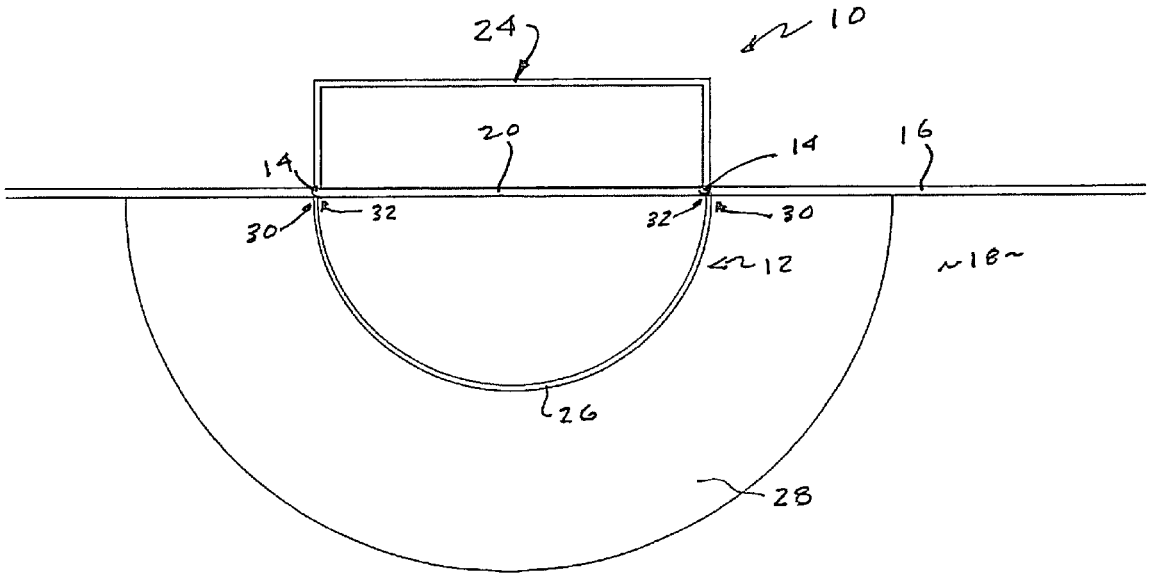
FIG. 2 is a plan view of the goal.

Referring to the accompanying drawings, there is illustrated an ice hockey goal 10 equipped with a training appliance 12 according to the present invention. The goal includes two posts 14, spaced apart along a goal line 16 marked on the playing surface 18. A crossbar 20 joins the upper ends of the posts to form an open goal mouth 22. The posts and crossbar are supported by a goal frame 24, which also supports goal netting (not illustrated). As illustrated, the goal may be of entirely conventional configuration.

For training purposes, an outwardly bowed band 26 is mounted on the goal at a position spaced part way up the posts and spaced to the front of the goal mouth 22, above the conventional goal crease 28 that is marked on the playing surface 18. The band 26 is a flat strip of resilient, transparent plastic material. The ends 30 of the band, are mounted on respective ones of the posts 14 by mounts 32. In the embodiment illustrated in FIG. 1, the mounts are elastic cords 34, commonly referred to as "bungee" cords.

Figure 3:
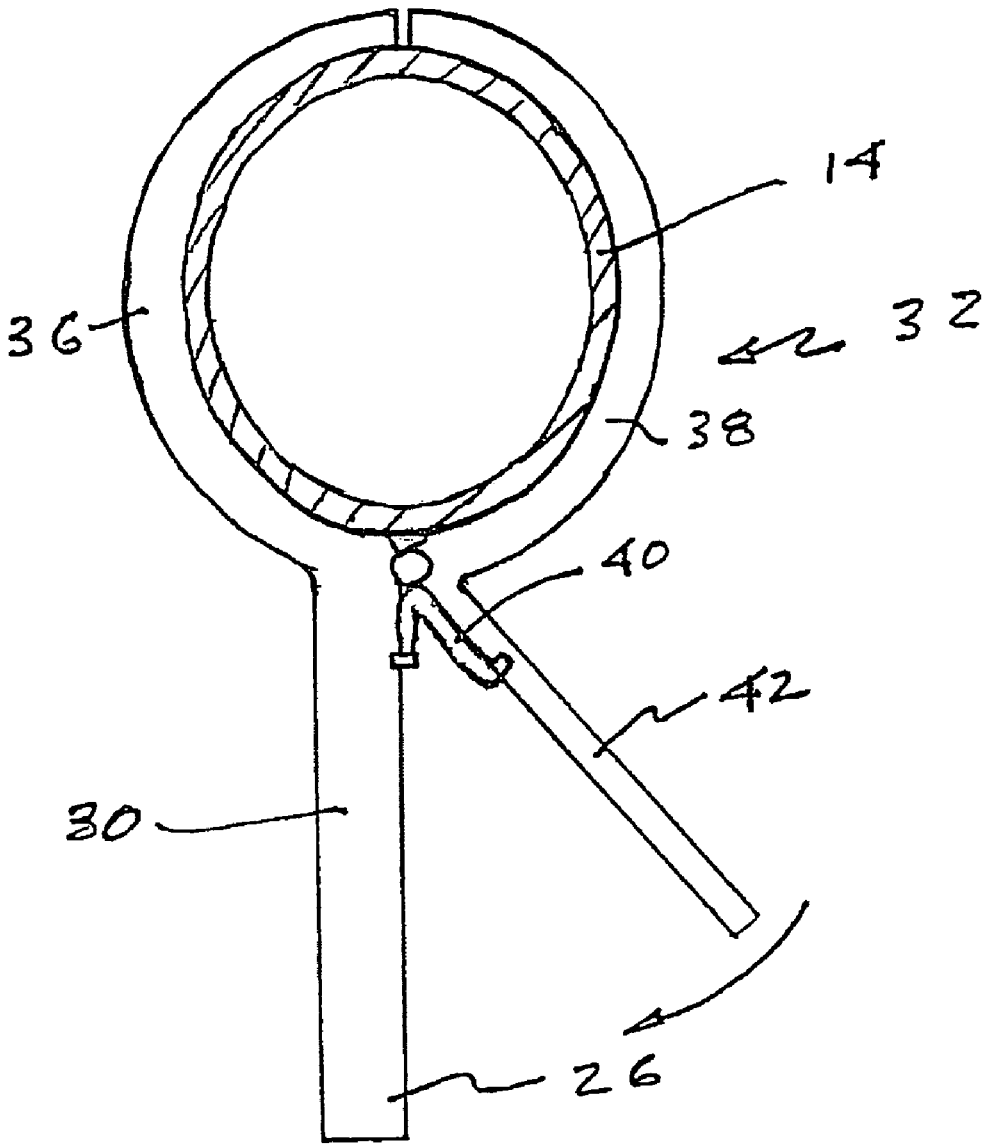
FIG. 3 is a cross section through a post showing one form of mounting means.

In the embodiment illustrated in FIG. 3, the end 30 of the band is formed into a concave "cup" 36 for engaging one side of a post 14. A concave clamp 38 is mounted pivotally on the band, to confront the cup so as to engage the post 14 between the two. A spring 40 biases the clamp towards the end of the band to grip the post. A handle 42 on the clamp allows the clamp the be opened for mounting, dismounting or adjusting the position of the band on the post.

In use, the band is mounted on the goal before a practice. This prevents the goaltender from backing into the goal and develops a sense of where further retreat towards the goal becomes of no additional positional value.

While one embodiment of the present invention has been described in the foregoing, it is to be understood that other embodiments are possible within the scope of the invention. Thus, for example, the band may be a permanent fixture on a practice goal where goals other than the regular game goals are employed. The flat, resilient, transparent strip is the currently preferred band configuration, but others are possible a and may be employed. Likewise, the mounts may take any suitable form for mounting the band on a goal, whether the posts, the crossbar or some other part of the frame. The invention is therefore to be considered limited solely by the scope of the appended claims.

The invention claimed is:

1. A training appliance and a goal in combination for training a goaltender in a sport:

the goal comprising two, spaced apart upright posts and a crossbar joining the posts to define a goal mouth; and the appliance comprising a band of stiff material mounted on the goal at a position spaced to a front side of the goal mouth and extending transversely thereacross, the band comprising an elongate, resilient member, bowed outwardly across the goal mouth.

2. A combination according to claim 1 wherein the band is adjustably mounted along the posts for adjusting the height of the band.

3. A combination according to claim 1 wherein opposite ends of the band are mounted on respective ones of the posts.

4. A combination according to claim 3 wherein clamps mount the opposite ends of the band on the respective ones of the posts.

5. A combination according to claim 3 wherein elastic cords mount the opposite ends of the band on the respective ones of the posts.

6. A training goal comprising:

two, spaced apart upright posts;

a crossbar joining the posts to define a goal mouth;

a band of stiff material mounted on the goal at a position spaced to a front side of the goal mouth and extending transversely thereacross, the band comprising an elongate, resilient member, bowed outwardly across the goal mouth.

7. A goal according to claim 6 including band mounting means for mounting the band on the goal.

8. A goal according to claim 6 wherein the band is adjustably mounted along the posts for adjusting the height of the band.

9. A training appliance according to claim 6 wherein opposite ends of the band are mounted on respective ones of the posts.

10. A training appliance according to claim 9 wherein clamps mount the opposite ends of the band on the respective ones of the posts.

11. A training appliance according to claim 9 wherein elastomeric cords mount the opposite ends of the band on the respective ones of the posts.

12. A method of training a goaltender for a sport the method comprising:

A) providing a goal including two spaced apart upright posts and a crossbar joining the posts to define a goal mouth B) providing a band of stiff material comprising an elongate resilient member; and C) mounting the band on the goal at a position spaced to a front side of the goal mouth and extending transversely thereacross such that the band is bowed outwardly across the goal mouth.

* * * * *